United States Patent [19]

Yarimie et al.

[11] 4,241,465

[45] Dec. 30, 1980

[54] WAVELESS WATERBED MATTRESS

[75] Inventors: Chris M. Yarimie; Jerry E. Moore, both of Cloverdale, Calif.

[73] Assignee: New World Manufacturing, Inc., Cloverdale, Calif.

[21] Appl. No.: 713

[22] Filed: Jan. 3, 1979

[51] Int. Cl.[3] ..... A47C 27/08

[52] U.S. Cl. ..... 5/452; 5/457

[58] Field of Search ..... 5/451, 452, 457, 458, 5/449

[56] References Cited

U.S. PATENT DOCUMENTS

| | | | |
|---|---|---|---|
| 3,736,604 | 6/1973 | Carson, Jr. | 5/451 |
| 3,918,110 | 11/1975 | Cantillo et al. | 5/452 |
| 4,145,780 | 3/1979 | Fogel | 5/451 |
| 4,152,796 | 5/1979 | Fogel | 5/457 |

*Primary Examiner*—Roy D. Frazier
*Assistant Examiner*—Alexander Grosz
*Attorney, Agent, or Firm*—Flehr, Hohbach, Test, Albritton & Herbert

[57] ABSTRACT

Waterbed mattress having an internal honeycomb baffle structure for preventing undesired wavelike motion of the water within the mattress. The honeycomb structure is detached from the top wall so that it does not interfere with the normal flotation support of the mattress. Openings in the baffle structure permit the water to circulate and prevent the formation of "hot spots" in the mattress.

5 Claims, 5 Drawing Figures

WAVELESS WATERBED MATTRESS

This invention pertains generally to waterbeds and more particularly to waterbeds of the type having means for suppressing wavelike motion of the water within the mattress.

Notwithstanding the popularity of waterbeds in recent years, many people are disturbed by the wavelike motion of the water in such beds, and this problem has caused waterbeds to be rejected in many instances. There have been attempts to eliminate the wavelike motion, for example, by the use of longitudinally extending baffles connected to the top and bottom walls of the mattress. While such baffles do tend to retard the propagation of waves laterally across the mattress, they create another problem in that they restrict the movement of the top wall and can result in overinflation in localized regions of the mattress. The overinflation make the mattress excessively firm and prevents the desired flotation support in the regions where it occurs. Another problem with waveless mattresses heretofore provided is that the water can become trapped in portions of the mattress, resulting in excessive heating or "hot spots" in such regions.

It is in general an object of the invention to provide a new and improved waterbed mattress having means for suppressing undesired wavelike motion of the water in the mattress.

Another object of the invention is to provide a mattress of the above character in which the top wall remains untensioned and free to move to permit the desired flotation support.

These and other objects of the invention are achieved by providing a waterbed mattress having a flexible enclosure including a top wall and a bottom wall defining a chamber for holding a body of water, and a honeycomb baffle structure interiorly dividing the chamber into a plurality of compartments. The honeycomb structure is affixed to the enclosure towards the sides thereof, with no connection between the honeycomb structure and the central portion of the top wall.

Figure 1:
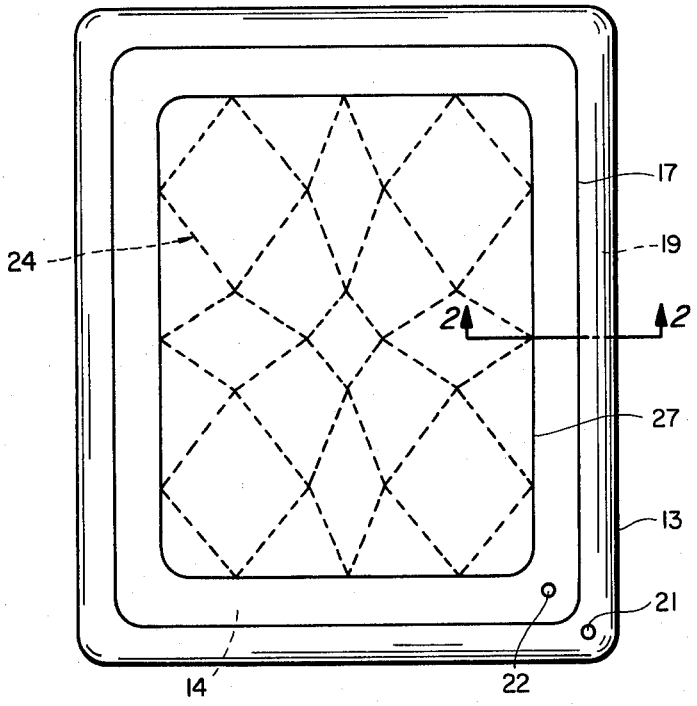
FIG. 1 is a top plan view of one embodiment of a waterbed mattress according to the invention.
Figure 2:
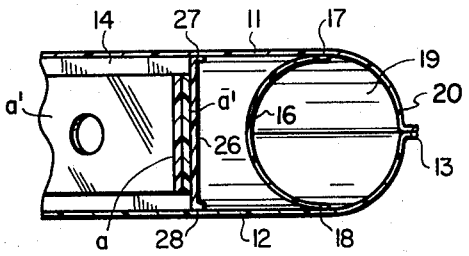
FIG. 2 is an enlarged, fragmentary cross sectional view taken along line 2—2 in FIG. 1.

The mattress includes a top wall 11 and a bottom wall 12 which are joined together at their peripheral margins, as indicated at 13 in FIG. 2, to form an enclosure having an internal chamber 14 for holding a body of water. The sheets are fabricated of a flexible material such as 27-mil vinyl plastic, and they are joined together by suitable means such as heat sealing or sonic welding. In the embodiment shown, the sheets are joined together by a butt seam, but a lap seam or other suitable means for interconnecting the sheets can be utilized, if desired.

A peripherally extending wall 16 is joined to the top and bottom walls along lines 17,18 which are spaced inwardly from seam 13. This wall forms the outer wall of chamber 14 and cooperates with the outer portions of the top and bottom walls to form a separate chamber 19 which is filled with air to provide a cushion at the lateral periphery of the mattress. When the mattress is inflated, the outer portions of top wall 11 and bottom wall 12 form a sidewall 20, as illustrated in FIG. 2.

Valves 21 and 22 are mounted in the top wall of the mattress to permit air and water to be introduced into and removed from the respective chambers.

Means is provided for preventing undesired wavelike movement of the water within the mattress. This means comprises a honeycomb baffle structure 24 which divides the chamber 14 into a plurality of smaller compartments. The baffle structure occupies the major portion of chamber 14, and in a king-size bed, for example, measuring 72×84 inches, the baffle structure can have a width of about 50 inches and a length of about 63 inches.

The baffle structure includes an upstanding parametric wall 26 which is bonded to the top and bottom walls of the mattress along lines 27,28 which are spaced inwardly from the points of attachment of wall 16 by about 6 inches. Wall 26 is fabricated of two elongated strips 31,32 of flexible material which are joined together at their ends to form a continuous band.

The honeycomb structure is fabricated of strips 33,34 of flexible material which are folded and bonded together along predetermined lines to form the desired compartments. Strips 33,34 are also bonded to strips 31,32 along vertically extending lines 36 spaced about the periphery of wall 26. Strips 31,32 are about two inches higher than strips 33,34, and there is no connection between the honeycomb structure and the central portion of either the top wall or the bottom wall. In the preferred embodiment, wall 26 is fabricated of 27-mil vinyl, and the internal baffles are fabricated of 20-mil vinyl. Other suitable materials and weights of material can be utilized if desired. Openings 37 are formed in each section of the honeycomb and the circumscribing wall to improve the circulation of water and prevent the formation of "hot spots".

Figure 4:
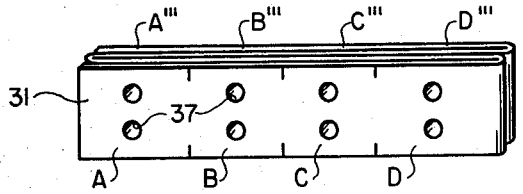
FIGS. 4 and 5 are schematic plan views of strips of material utilized in the baffle structure of FIG. 3.
Figure 5:
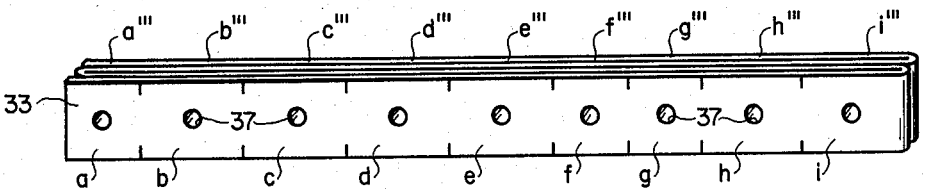
Figure 3:
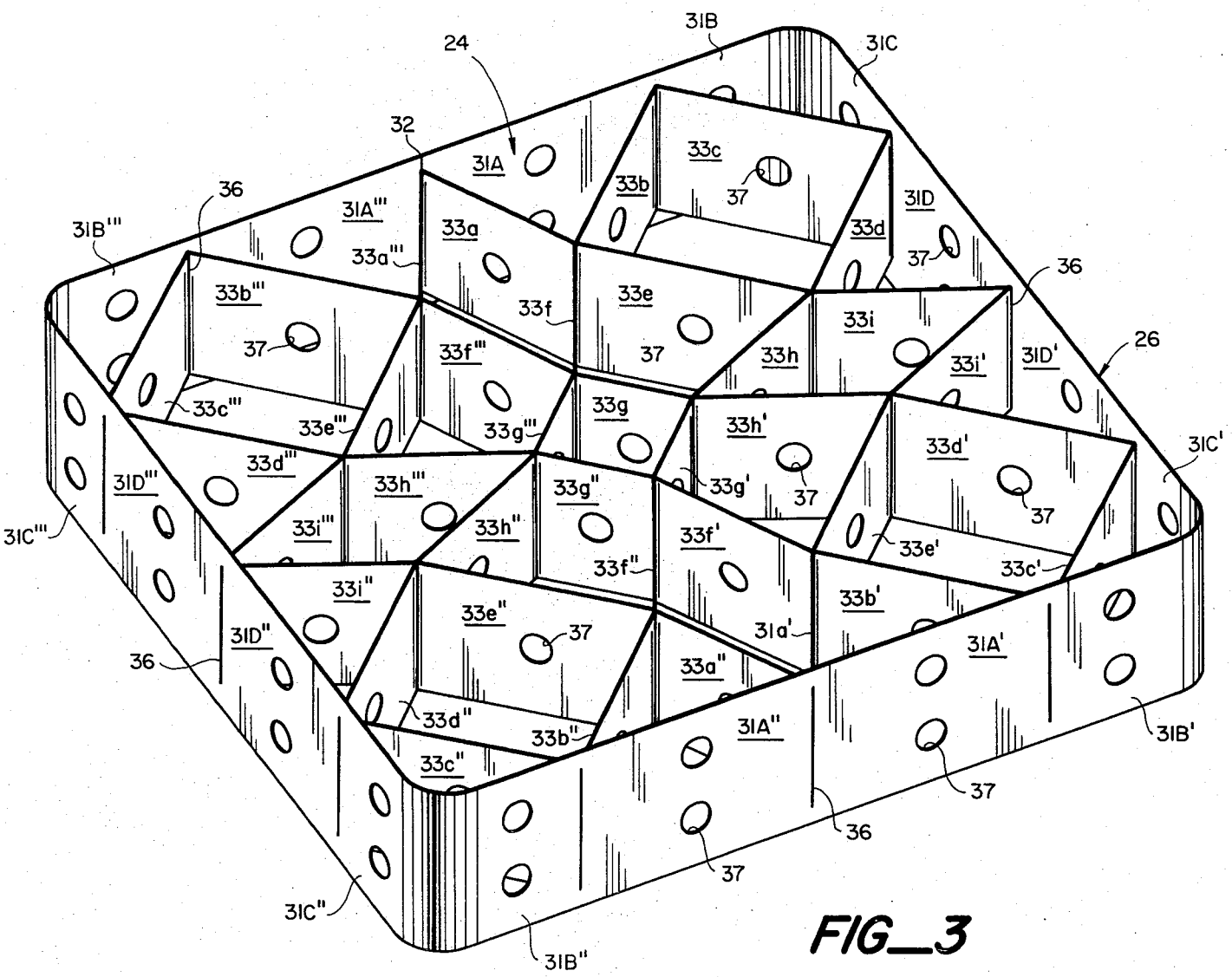
FIG. 3 is an enlarged isometric view of the baffle structure of the mattress of FIG. 1.

The strips utilized in the fabrication of the baffle structure of FIG. 3 are illustrated in FIGS. 4 and 5. In a presently preferred method of manufacture, the strips are marked into the desired sections, the holes are punched, and the strips are then assembled together. Each of the strips is symmetrical about its vertical centerline, and by folding each strip back upon itself, the two halves of the strip can be marked and punched simultaneously. By superimposing the two folded strips of each type, they can both be marked and punched in a single operation.

In the embodiment illustrated, strips 31,32 are each divided into 8 sections designated A-D and A'-D', and strips 33,34 are each divided into 18 sections designated a-i and a'-i'. The marks which separate the sections designate the seam lines along which the strips are joined together to form the baffle structure.

Once the baffle structure has been formed, it is placed between the sheets which form the top and bottom walls, and the upper and lower margins of wall 26 are bonded to the top and bottom walls. Wall 16 is then bonded to the top and bottom walls, and finally the outer margins of the sheets are joined together to form seam 13.

In use, air chamber 19 is inflated, and the mattress is placed on a suitable planar supporting surface, either with or without a rigid circumscribing framework. Water is then introduced into chamber 14 to the desired level.

Thereafter, any trapped air is worked out of the chamber, and valve 22 is closed to seal the chamber.

The honeycomb baffle structure divides the chamber into compartments of sufficiently small size that waves of objectionable magnitude are unable to develop. At the same time, the water is relatively free to circulate throughout the chamber through openings 37 and the spaces between the baffles and the top and bottom walls of the mattress. Since the top wall is not connected to the baffles, the baffles do not interfere with the flotation support, and a person resting on the mattress will not feel the baffles.

Although the invention has been described with specific reference to a mattress having a peripheral air cushion, it is not limited to mattresses of this type. If an air cushion is not desired, wall 16 can be omitted, and the entire enclosure can be filled with water. Similarly, wall 26 can form the side wall of the mattress, in which case wall 26 would be made without openings 37, and the top and bottom walls would terminate at this wall.

It is apparent from the foregoing that a new and improved waveless waterbed mattress has been provided. While only one presently preferred embodiment has been described in detail, as will be apparent to those familiar with the art, certain changes and modifications can be made without departing from the scope of the invention as defined by the following claims.

What is claimed is:

1. In a waterbed mattress: a flexible enclosure including a top wall, a bottom wall and a side wall defining a chamber for holding a body of water, and a honeycomb baffle structure having a plurality of wall sections bonded together dividing the chamber into a plurality of compartments, said honeycomb structure being affixed to the enclosure in the vicinity of the sidewall, with no connection between the honeycomb structure and the central portion of either the top wall or the bottom wall.

2. In a waterbed mattress: top and bottom walls of flexible material defining therebetween a chamber for holding a body of water, an upstanding parametric wall interconnecting the top and bottom walls toward the lateral margins thereof, and a honeycomb baffle structure having a plurality of wall sections bonded together dividing the chamber into a plurality of compartments, said honeycomb structure being affixed only to the parametric wall with no connection between the honeycomb structure and the central portion of either the top wall or the bottom wall.

3. The mattress of claim 2 wherein the top and bottom walls are joined together outwardly of the upstanding wall to form a peripheral air chamber.

4. The mattress of claim 2 or claim 3 together with a second upstanding wall interconnecting the top and bottom walls outwardly of the first-named upstanding wall.

5. In a waterbed mattress: top and bottom walls of flexible material defining a chamber for holding a body of water, an upstanding parametric wall connected to the top and bottom walls toward the lateral margins thereof, and an elongated strip of flexible material folded and bonded to form a honeycomb baffle structure which divides the chamber into a plurality of intercommunicating compartments, said honeycomb structure being affixed only to the parametric wall with no connection between the honeycomb structure and the central portion of either the top wall or the bottom wall.

* * * * *